United States Patent [19]

Antonious

[11] Patent Number: 4,919,430

[45] Date of Patent: Apr. 24, 1990

[54] GOLF CLUB HEAD

[76] Inventor: Anthony J. Antonious, 205 E. Joppa Rd., Towson, Md. 21204

[21] Appl. No.: 345,222

[22] Filed: May 1, 1989

Related U.S. Application Data

[63] Continuation-in-part of Ser. No. 25,094, Mar. 12, 1987, Pat. No. 4,826,172.

[51] Int. Cl.[5] ..... A63B 53/04

[52] U.S. Cl. ..... 273/169; 273/167 H

[58] Field of Search ..... 273/167 R, 167 F, 167 H, 273/169, 170, 171, 172, 173, 174, 175, 167 D; D21/220

[56] References Cited

U.S. PATENT DOCUMENTS

| | | | |
|---|---|---|---|
| D. 244,703 | 6/1977 | Guzzle et al. | 273/167 D |
| 3,655,188 | 4/1972 | Solhelm | 273/169 |
| 3,814,437 | 6/1974 | Winguist | 273/167 R |
| 3,847,399 | 11/1974 | Raymont | 273/169 |
| 4,826,172 | 5/1989 | Antonious | 273/169 |

*Primary Examiner*—George J. Marlo
*Attorney, Agent, or Firm*—N. J. Aquilino

[57] ABSTRACT

A perimeter weighted iron-type golf club head with a recessed of cavity back and a peripheral mass having an improved weight configuration formed of angularly disposed weight members within the cavity which are positioned adjacent to and on opposite sides of the center of gravity of the golf club head and located between the center of gravity and the peripheral mass of the golf club head.

10 Claims, 1 Drawing Sheet

GOLF CLUB HEAD

RELATED APPLICATION

The present application is a continuation-in-part of Serial No. 07/025,094 filed Mar 12, 1987, now U.S. Pat. No. 4,826,172, entitled Golf Club Head.

BACKGROUND OF THE INVENTION

1. Field of the Invention

The present invention relates to perimeter weighted golf club heads, and more particularly to recessed or cavity back iron type perimeter weighted golf club heads, having an improved weight distribution and configuration.

2. Description of the Prior Art

Over the years, iron type golf club heads have evolved from essentially flat blades to club heads adapted to improve the efficiency and control of the clubs by using numerous designs and weight configurations. Attempts at maximizing the weight characteristics of a golf club have included providing a solid back club, providing the majority of the weight on the back of a golf club head at the heel and at the toe portion of the club head, concentrating the weight at the bottom of the golf club head, concentrating the weight at both the bottom of the club head and the heel-toe areas, and locating the weight around the periphery of the golf club head. The latter attempt provides a deep recessed cavity in the back of the club head which is centrally located in the back of the club head.

Although the evolution of iron type golf club head designs has produced improvements over the original flat blades, the newer club head designs have limitations in distance, feel and control. For example, conventional iron-type heads with solid backs provide a solid feel but less distance and accuracy when miss-hit. Conventional cavity back clubs are more forgiving when the golfer miss-hits the ball, but they still sacrifice appreciable distance and accuracy when miss-hit. The other prior art iron-type club head designs have exhibited deficiencies in distance, feel and/or control.

SUMMARY OF THE INVENTION

The present invention overcomes the problems and disadvantages of the prior art by providing peripheral weighted iron type golf club heads and having a recessed or cavity back with additional weight members designed and positioned to provide increased control and feel, without sacrificing accuracy and distance.

An object of the present invention is to provide a peripheral weighted iron type golf club which permits a golfer to achieve improved control, feel, accuracy and distance.

Another object is to provide an iron type golf club head design that minimizes variances of the ball's flight when a ball is hit off-center, without sacrificing accuracy and distance of the ball's flight.

Still another object is to improve the playing performance of perimeter weighted golf club heads, particularly of the iron type, wherein a cavity in the back of the club head is defined by peripheral mass providing perimeter weighting of the club head by maximizing off-center hits of a golf ball, causing the ball to go farther and straighter when struck off the center of gravity (CG) of the club head.

In particular, an object of the present invention is to improve upon peripheral mass, perimeter weighting club head systems by having weight members between the club's center of gravity (CG) and the peripheral mass of the club head at points which are located adjacent to the center of gravity (CG) and are positioned at areas where golf balls are more frequently struck when the percussion center is missed. The additional weight members are optimally located and provide an increased stability and mass configuration causing miss-hit golf balls to travel farther and straighter and with a proper trajectory.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a weighting system for an iron-type golf club head including a hosel, a heel, a toe, an upper surface, a lower surface, a rear surface, a ball striking face, a complememtary rear surface, and a center of gravity (CG), the weighting system comprising a peripheral mass formed on at least the heel, toe and lower surface portions of the outer periphery of the rear surface of the club head, the peripheral mass defining a cavity at the rear surface of the club head and providing a perimeter weighting for the club head, and at least two opposing weight members formed at the rear surface and within the rear cavity of the club head, the respective opposing weight members being located on opposite sides of the center of gravity (CG) and being positioned between the center of gravity (CG) and opposing sides of the peripheral mass.

In the specific embodiment of the present invention, the weight members take the form of a plurality of angularly disposed weight members adjacent to and on opposite sides of the center of gravity(CG)in the area adjacent regions where most missed hits of a golf ball are made.

DESCRIPTION OF PREFERRED EMBODIMENTS

Figure 1:
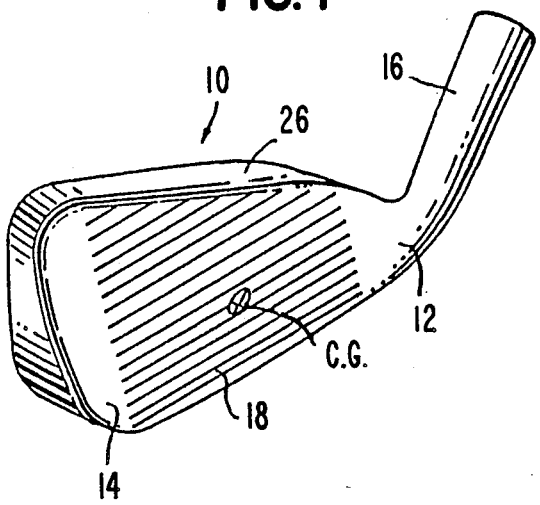
FIG. 1 is a front perspective view of a golf club head in accordance with the present invention.

Reference will now be made in detail to the present preferred embodiments of the invention, examples of which are illustrated in the accompanying drawings. Wherever possible, the same or like reference numerals will be used throughout the drawings to refer to the same or like parts.

Figure 2:
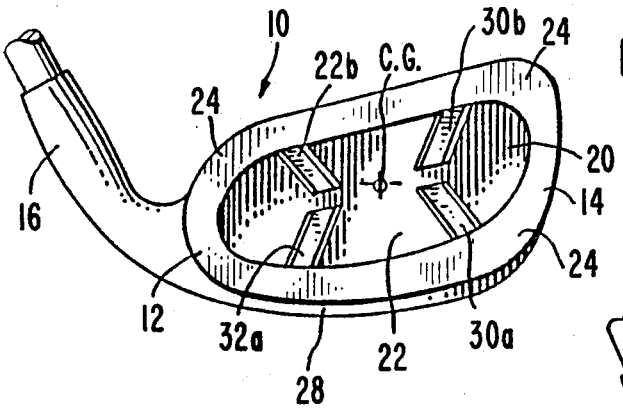
FIG. 2 is a rear elevational view of a golf club head of FIG. 1.

FIGS. 1 to 2 illustrate one embodiment of a golf club head of the present invention. The club head 10 is an iron type including a heel 12, toe 14, hosel 16, and ball striking face 18, and a complementary rear surface 20. As illustrated in the drawings, the club head 10 has a center of gravity (CG) shown on the ball striking face 18, and also on the rear surface 20 of the club head 10.

Preferrably the center of gravity (CG) is located at approximately the center of the club head and at the center of percussion where a ball is struck to provide maximum distance and control. The club head 10 includes a rear cavity 22 which is defined by a peripheral mass 24 which concentrates the weight of the club head around the outer edge of the golf club head as illustrated in FIG. 2.

In this embodiment, four weight members 30*a* and 30*b* and 32*a* and 32*b* are shown within the cavity 22 and are angularly disposed with respect to the longitudinal axis of the club head 10. These weight members effectively surround the center of gravity (CG). As shown, the pair of weight members 30*a* and 30*b* adjacent to the toe 14 and the pair of weight members 32*a* and 32*b* adjacent the heel 12 angle inwardly from the peripheral mass 24 in a direction toward the center of gravity (CG). The pair of members 30*a* and 30*b* are connected to the respective bottom and top of the peripheral mass 24 and the rear face of the cavity 22. These members are positioned adjacent to the center of gravity (CG) and are spaced from each other within the cavity 22. The members 32*a* and 32*b* are similarly designed. As can be seen from the drawings, weight members 30*a* and 32*b* are parallel. Likewise, weight members 30*b* and 32*a* are also parallel.

This embodiment preferably would be used by golfers of a relatively high caliber where off-center hits are not as frequent or severe as golfers with lesser skills. This embodiment provides a more solid feel at or near the center of gravity (CG) when the club head impacts a golf ball.

Figure 3:
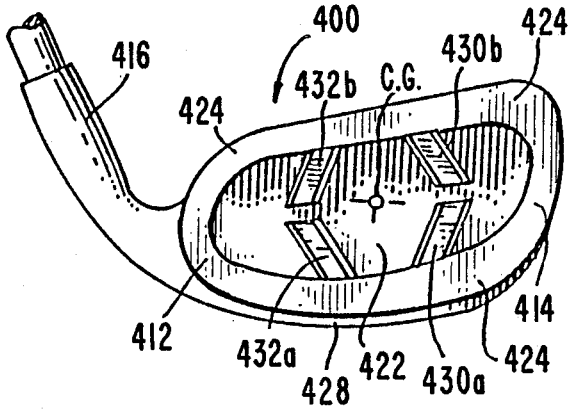
FIG. 3 is a rear elevational view of a second embodiment of a golf club head of the present invention.

FIG. 3 illustrates a second embodiment of a golf club head 400 of the present invention including a heel 412, toe 414, and hosel 416. This embodiment includes a cavity 422 and a peripheral mass 424 disposed around the cavity 422. Weight members 430*a* and 430*b* an 432*a* and 432*b* are also angularly disposed with respect to the bottom 428 of the golf club head 400 and surround the center of gravity (CG). This embodiment is similar to that shown in FIG. 2, but in this embodiment the weight members angle outwardly away from the center of gravity (CG) of the golf club head 400. This embodiment provides better control and feel for a golfer who miss-hits the ball more often.

Figure 4:
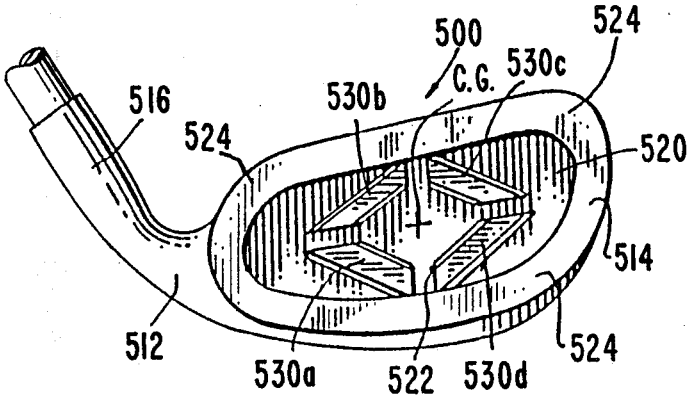
FIG. 4 is a rear elevational view of a third embodiment of a golf club head of the present invention.

FIG. 4 illustrates a third embodiment of a golf club head 500 of the present invention including a heel 512, toe 514, and a hosel 516. This embodiment includes a cavity 522 and a peripheral mass 524 disposed around the cavity 522. A series of weight members 530*a*, 530*b*, 530*c* and 530*d* are shown angularly disposed to form a diamond shaped configuration surrounding the center of gravity (CG). These weight members are attached to the rear face 520 within the cavity 522, and are spaced from each other.

It will be appreciated that the angularly disposed weight members can be used to accommodate the optimum playing characteristics of a particular golfer's swing by varying the size and location of the shaped weights within the cavity. Other various changes such as the shape of the weight members can be made in keeping within the spirit and scope of the present invention as defined in the following claims.

I claim:

1. An iron type golf club head having an improved weighting system, said club head having a hosel, a heel, a toe, a bottom surface, an upper surface, a rear surface, a ball striking face, and a center of gravity;

a peripheral mass formed on said rear surface adjacent at least said heel, toe and bottom surface of said club head, said peripheral mass defining a cavity formed within said peripheral mass;

said weighting system including at least two opposing weight members formed within said cavity on said rear surface of the club head, the respective opposing weight members being located on the opposite sides of the center of gravity, said cavity being devoid of any weight member formed on said rear surface at the location of said centre of gravity, at least one weight member being located between and spaced from the center of gravity and the toe and at least a second opposing weight member being located between and spaced from the center of gravity and the heel;

said opposing weight members being angularly disposed with respect to the longitudinal axis of said club head and said weight members being spaced a substantial distance from said center of gravity so that no portion thereof is located at said center of gravity.

2. The golf club head of claim 1 wherein said weight members are angularly disposed toward said center of gravity.

3. The golf club head of claim 1 wherein said weight members are angularly disposed away from said center of gravity.

4. The golf club head of claim 1 wherein said two opposing weight members are combined with additional weight members so that a first plurality of weight members are angularly disposed between said toe and said center of gravity and a second plurality of weight members are angularly disposed between said heel and said center of gravity.

5. The golf club head of claim 4 wherein said first and second plurality of weight members form a diamond shape centered about said center of gravity.

6. The golf club head of claim 4 wherein said weight members are angularly disposed toward said center of gravity.

7. The golf club head of claim 4 wherein said weight members are angularly disposed away from said center of gravity.

8. The golf club head of claim 1 wherein said two opposing weight members are parallel to each other.

9. The golf club head of claim 1 wherein said weight members are angularly disposed with respect to each other.

10. An iron type golf club head having an improved weighting system, said club head having a hosel, a heel, a toe, a bottom surface, an upper surface, a rear surface, a ball striking face, and a center of gravity;

a peripheral mass formed on said rear surface adjacent at least said heel, toe and bottom surface of said club head, said peripheral mass defining a cavity formed within said peripheral mass;

said weighting system including at least two opposing weight members formed within said cavity on said rear surface of the club head, the respective opposing weight members being located on the opposite sides of the center of gravity, said cavity being devoid of any weight member formed on said rear surface at the location of said center of gravity, at least one weight member being located between and spaced from the center of gravity and the toe and at least a second opposing weight member being located between and spaced from the center of gravity and the heel;

said opposing weight members being parallel with respect to each other and angularly disposed with respect to the longitudinal axis of said club head and said weight members being spaced a substantial distance from said center of gravity so that no portion thereof is located at said center of gravity.

* * * * *